United States Patent [19]

Sullivan et al.

[11] 4,380,843

[45] Apr. 26, 1983

[54] DROOP CORRECTION STRUCTURE AND CONDENSATE CONTROL IN SOOTBLOWERS

[75] Inventors: Robert P. Sullivan, Chattanooga; Clyde L. Jacobs, Signal Mountain, both of Tenn.

[73] Assignee: Combustion Engineering, Inc., Windsor, Conn.

[21] Appl. No.: 213,990

[22] Filed: Dec. 8, 1980

[51] Int. Cl.[3] ..... F23J 3/00

[52] U.S. Cl. ..... 15/316 R

[58] Field of Search ..... 15/316 R, 316 A, 317, 15/318

[56] References Cited

U.S. PATENT DOCUMENTS 3,111,701 11/1963 Cantieri ..... 15/317

4,193,158 3/1980 Blaskowski ..... 15/317

*Primary Examiner*—Chris K. Moore

*Attorney, Agent, or Firm*—Arthur L. Wade

[57] ABSTRACT

A long-stroke sootblower is mounted to extend over a fulcrum at the entrance to the furnace space. The track traversed by the end of the outer casing of the blower is sloped upward to the fulcrum in control of the vertical position of the nozzle-bearing end of the blower extended into the furnace space. Drain points on the blower remove condensate formed from the residual steam and that which may leak through the valve admitting steam to the feed tube of the blower structure.

6 Claims, 1 Drawing Figure

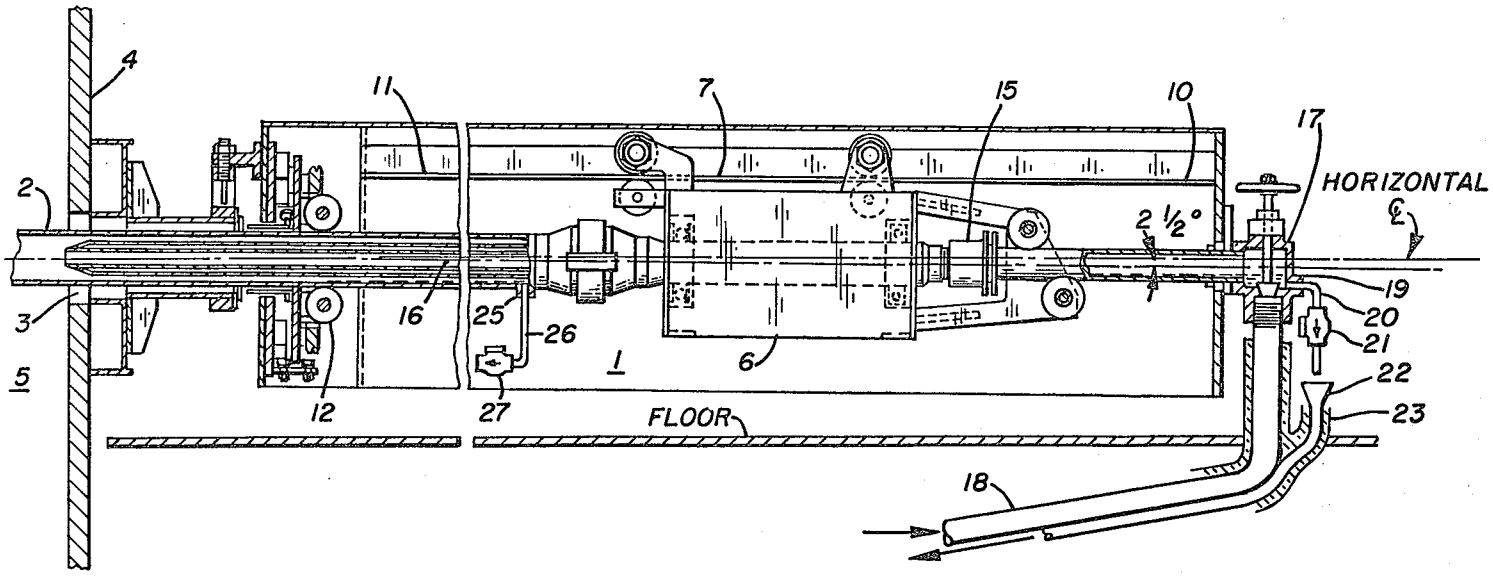
HORIZONTAL
℄
2 1/2°
FLOOR
1
2
3
4
5
6
7
10
11
12
15
16
17
18
19
20
21
22
23
25
26
27

DROOP CORRECTION STRUCTURE AND CONDENSATE CONTROL IN SOOTBLOWERS

TECHNICAL FIELD

The present invention relates to compensating for droop of long-stroke retractable sootblower lances, and drain of resulting condensate from within the feed tube and lance. More particularly, the invention relates to simplifying droop correction structure for long-stroke sootblower lances, and isolation of condensate within the lances from the furnace.

BACKGROUND ART

As set forth in U.S. Pat. No. 4,207,648 issued June 17, 1980, combustion of fuels in a utility boiler produces high amounts of particulate matter which accumulate on heated surfaces and reduces the heat transfer from the combustion to liquids to be vaporized. Coal firing produces large amounts of particulate matter, be it in the form of soot and/or slag. The lower the quality of coal, the more quickly is the accumulation of particulate matter on surfaces heated by the combustion. Removing structure must be frequently inserted into the furnace space to sheer away the accumulations which are the enemies of heat transfer.

Enter the lowly sootblower. Essentially, the sootblower is a tube, with a nozzle at its end, with means to insert it into a hole in the wall of the furnace. Steam, or other vapor, is fed into the tube and ejected from its nozzle with great force. Correctly positioned and directed, this vapor-belching tube can effectively sheer particulate matter from large areas of the heated surfaces.

In the huge, multi-storied utility boiler, it is not uncommon to mount up to 100 sootbloowers at external positions about the furnace. Horizontal rows of these blowers are poised at their furnace openings, the rows being vertically spaced from each other at approximately 8' intervals. Further, the nozzles are rolled into the furnace under elaborate programs to sequentially cut at the accumulations on the heating surfaces and maintain the efficiency of heat transfer from the combustion process to the vaproizable liquid behind the heating surfaces.

A vulnerable structure is the basic seal by which the cleaning vapor is retained within the outer casing of the lance. Although other vapors could be employed, by and large, high pressure steam is the most available cleaning medium. The steam is conducted to each blower though a feed tube. The outer casing of the lance, telescoped over the feed tube, is rotated and reciprocated over a substantial length of the feed tube, traveling into and out of the furnace space. Obviously, some form of seal between the outer surface of the feed tube and the inner surface of the outer casing of the lance is necessary to control the cleaning medium and force it from a nozzle mounted on the forward end of the casing. This basic seal must be protected from mechanical stress if reasonable life for it is to be expected.

The length of the outer casing of the lance, thrust into the furnace space, can be at least 50 feet. Fulcrumed near the entrance into the furnace, the nozzle-bearing end of the casing droops, or dipslaces vertically, a distance which depends upon the length of casing, the strength of the casing material, and the temperature to which the casing is subjected within the furance. Of course, this vertical displacement from the horizontal travel of the rear of the casing must be known in order to bring the nozzles into effective spatial relationship with the heating surfaces brought under the cleaning force of steam issuing from the nozzles.

It has been common practice to incline the lance toward the furance space so that condensing vapor within the outer casing and feed tube drains into the furance. The control of the droop of the nozzle end of the extended outer casing has been exerted by applying a downward force on the blower casing at a point horizontally spaced from the fulcrum at the furance entrance. This downward force has been predetermined to, in turn, establish the desired location of the extended nozzle end of the outer casing. However, the application of vertical forces to the structure, for bringing the nozzle to its desired position within the furnace, has distorted the feed tube and resulted in forces on its seal to the casing which has drastically shortened the life of the seal. Further, experience now indicates that the cooling effect of this condensed vapor dumped into the furance produces thermal shocks, and possible corrosion, on both the web welding between boiler tubes and tube studs which lead to tube failure.

The long-stroke sootblower lance must now be mounted to simplify the droop-correcting structure and obviate the dumping of the resulting condensed cleaning vapor toward and into the furance opening through which the lance casing reciprocates.

DISCLOSURE OF THE INVENTION

The present invention contemplates maintaining a fulcrum beneath the outer casing of a sootblower lance at the furance entrance and displacing the end of the retracted casing to provide a predetermined vertical displacement of the nozzle-bearing end of the casing when extended into the furnace space while providing drain passages from the feed tube and casing for vapor condensate formed when the blower is in its retracted position. A first drain passage is specifically provided at the steam valve end of the feed tube to drain condensate from the feed tube from its lowest point. A second drain passage is provided at the lowest point in the outer casing of the lance to drain any condensate forming in the casing and collecting between the feed tube and the outer casing sealed to the feed tube.

Other objects, advantages and features of this invention will become apparent to one skilled in the art upon consideration of the written specification, appended claims, and attached drawing.

BRIEF DESIGNATION OF THE DRAWING

The drawing is a sectioned elevation of a sootblower framework as mounted for extension into a furnace space which embodies the present invention.

BEST MODE FOR CARRYING OUT THE INVENTION

The present disclosure is enhanced by reference to the form of long-stroke sootblowers disclosed in U.S. Pat. No. 4,207,648 issued June 17, 1980. As a matter of fact, for completeness, the disclosure of the patent is specifically incorporated in and made a part of this disclosure.

The drawing discloses the sootblower as mounted at the furnace wall, comparable to the disclosure of U.S. Pat. No. 4,207,648. Prominant parts of the sootblower framework 1 dominate the drawing as it is mounted and its casing 2 inserted through opening 3 of furnace wall 4. The length of the outer casing 2, extended into the furance space 5, is controlled by the position of carriage 6 along the length of track 7. As the present embodiment of the invention contemplates an outer casing length in the order of 50 feet, track 7 for carriage 6 is to be visualized, also, as having a length in the order of 50 feet. For the purposes of disclosing the present invention, these relative lengths may not be depicted in detail on the drawing. Suitable breaks in the track 7 and casing 2 are drawing techniques which adequately imply these lengths.

The embodiment of the invention begins with the vertically downward displacement of framework 1 and, therefore, the back end 10 of track 7. The front end 11 of track 7 is mounted with a fixed relationship to furnace wall opening 3 so that the outer casing 2 will be passed through opening 3. Entire framework 1, then, inclines at an angle of approximately 2½° to the horizontal plane through front end 11. The precise inclination of the framework and track must be fixed to accommodate the variable factors of furnace heat, material strength of casing 2, and the length of casing 2, to bring the nozzles of the casing to the proper position for their cleaning fluid to effectively remove material from the surfaces in furnace space 5.

Rollers are mounted at position 12 on the front end 11 of the framework 1 to bear upon the outer octagonal surface of casing 2 to bring about rotation of casing 2 while casing 2 is reciprocating. Positioned as they are, the rollers at 12 not only rotate casing 2, but additionally support casing 2 as a fulcrum. The result of this support is that casing 2 is given a seesaw configuration across the supporting rollers 12. The vertical displacement of the carriage 6 on the rear end of casing 2 determines the droop, or vertical displacement, of the nozzle-bearing end of casing 2 within furance space 5. Thus, only the smooth predicatable distortion of casing 2 across this single fulcrum support of the rollers provides a predetermined path for the nozzle end of casing 2 as the casing is thrust into furnace space 5. The seal 15, between feed tube 16 and the extended interior wall of casing 2 is subjected to minimum stress as casing 2 is reciprocated in its telescoping over feed tube 16 by utilizing rollers above and below track 7 at the front and rear of carriage 6, thus maintaining carriage 6 on track 7.

Heretofore, the prior art applied vertical forces on casing 2 in control of its droop. Track 7 was elevated at its end 10 above the horizontal plane through end 11. This inclination from end 10 to end 11 insured that any condensed steam within feed tube 16 and casing 2 would be flowed toward furnace space 5. This arrangement insured that the feed tube and casing would be drained of condensate to obviate corrosion, but the problem was thereby transferred to the tubes of the furnace wall 4. Particularly, if the valve controlling the steam into feed tube 16 developed a leak, the resulting condensate would continually drip down furnace wall 4 and provide on-going thermal shock to the web welding on the furance wall 4. This thermal shock and corrosion has been a source of tube failure which must be eliminated.

The basic answer to the condensate problem is met by the repositioning of framework 1 and, therefore, end 10 on track 7 downward, as disclosed in the drawing. Simultaneously, the control of droop over the single support point at position 12 substantially eliminates the stress on seal 15. At the same time, this arrangement to eliminate the stress on seal 15 includes the lowering of end 10 of carriage track 7, bringing about the inevitable accumulation of condensate within both feed tube and casing. The invention is completed by the disclosed arrangement for the continual draining of condensate from both tube and casing.

The supply of steam to feed tube 16 is controlled by valve 17. A source of steam, not shown, is connected to valve 17 by conduit 18. Conduit 18 is effectively connected to the rear end of feed tube 16 and valve 17. By the simple expedient of opening valve 17, conduit 18 is connected to feed tube 16 and steam flows into feed tube 16 and casing 2 for discharge from the nozzles on the furance end of casing 2. Although not disclosed here, valve 17 can be automatically operated by a connection between carriage 6 and valve 17 as casing 2 is inserted into furnace space 5. All of this operation is disclosed in U.S. Pat. No. 4,207,648. In the present disclosure, the problem is the removal of condensate from feed tube 16 and casing 2 when carriage 6 has reciprocated casing 2 out of furnace space 5.

Condensate drainage offers two separate problems. First, feed tube 16 is drained from its lowest point. This point is located at valve 17. As disclosed, the body of valve 17, itself, is drilled and tapped at 19 and conduit 20 connected into that chamber within the valve body downstream of the valve element. Conduit 20 has a valve 21 controlling the flow of condensate from feed tube 16, through the body of valve 17 and conduit 20. As shown in the disclosure, condensate drains from valve 21 into a funnel 22. Funnel 22 is drained through conduit 23 to a point of disposal, not shown. It is deemed obvious that the condensate, should its volume be justified, can be returned to the feed water system of the furnace in an arrangement that needs no disclosure here.

Casing 2 is telescoped over feed tube 16. Seal 15 is between the outer surface of feed tube 16 and the extended interior wall of casing 2. The result is an annular chamber in which condensate is collected as the entire lance is inclined. It is contemplated that the amount of condensate will not reach significant quantities. It is important that it be removed to prevent corrosion of the inside of casing 2 and the external surface of feed tube 16. Casing 2 is tapped at 25 and conduit 26 connected to the tapped hole to drain the condensate from the annulus formed between the feed tube and casing. Valve 27 controls the flow of this condensate and it is anticipated that a relatively small amount of condensate can be wasted to the floor on which the lance is mounted.

Designs are available for valves 21 and 27 which enable the valves to drain liquid therefrom under low pressure, and automatically close when the condensate is placed under the pressure from the steam. It is simple to provide a spring to lift the elements of these valves from their seats against low pressure in the space they drain. The valve springs are then overcome by significant steam pressure and the valve element seated to prevent the escape of the high pressure steam.

Conclusion

Experience with the sootblower structure of U.S. Pat. No. 4,207,648 has accumulated with testing of its actual reduction to practice. It now appears that the incline of the blower structure downwardly toward its entrance into the furnace was a crude technique for draining condensate from the steam tube and casing.

The condensate, of course, was drained from the lance but created thermal shock and corrosion problems on the mounting structure at the furnace opening and the furnace tubes beneath the opening.

Additionally, the droop of the long (50') casing inserted into the furnace was unacceptable. The application of force on the casing of the lance to correct the droop of its nozzle end created distortions of the feed tube which were transmitted to the seal between the feed tube and casing.

The present invention dramatically conceives of dropping the back of the framework of the blower to control the droop of the extended casing. This arrangement puts minimum stress on the tube-to-casing seal, providing a rather simple curve between the casing carriage and the furance end of the casing over its roller-support structure at the furnace entrance.

Having accepted the foregoing depression of the blower framework end, condensate collects in both the feed tube and the annulus between the feed tube and the casing. The invention then provides tfor tapping the lowest point in both of these volumes in order to withdraw the condensate as it collects therein.

With an open drain provided from the feed tube, leakage of the steam valve is evident from the consistency of the condensate draining from the feed tube. Without the steady drip of condensate on the wall box structure and down through the furnace wall opening, the maintenance of these structures is considerably reduced. With the support of the casing at the single point, there is a more simple control of the droop path traversed by the end of the casing as it is thrust into the furnace.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawing is to be interpreted in an illustrative and not in a limiting sense.

The invention having been described, what is claimed is:

1. A long-stroke sootblower, including, a track extending at a slope up to the entrance into a furnace space, a carriage mounted to follow the track, an outer casing mounted by one end to the carriage and extending to and through the furnace entrance, a support for the casing at the entrance of the furnace which maintains the supported casing in alignment with the furnace opening, a feed tube telescoped within the carriage end of the casing, a seal between the feed tube and the casing, a supply of steam for the feed tube, a valve connecting the steam supply to the feed tube, a check valve mounted at the steam valve through which condensate within the feed tube drains to a point external of the blower, and a valve connected to the carriage end of the casing through which condensate within the casing drains to a point external of the blower.

2. The blower of claim 1, wherein, the check valve at the steam valve is communicated with the valve chamber downstream of its element.

3. The blower of claim 2, wherein, the drain from the check valve is open for observation of the condensate draining from the feed tube.

4. A mounting and drain structure for a long-stroke sootblower, including, a sootblower having an elongated frame mounted at its front end over a furnace opening, a track extending the length of the frame which is inclined downwardly from its front end to its back end, a carriage mounted to travel the inclined track, a lance casing mounted by one end to the carriage and extending the length of the frame for reciprocation into a furnace space beyond the wall opening, a roller-support structure mounted at the first end of the frame for support of the lance casing as it is reciprocated into and out of the furnace space, a feed tube telescoped into the lance casing from the lower end of the frame, a seal between the feed tube and lance casing into which the tube is telescoped, a valve mounted on the lower end of the feed tube, a source of cleaning vapor under pressure connected to the valve, a drain connection communicated with the valve chamber downstream of its element to conduct condensed vapor from the feed tube, and a drain communicated with the annulus chamber between the telescoped feed tube and lance casing for drain of condensed vapors from the annulus.

5. The structure of claim 4, including, a first valve in the drain connection from the vapor valve which is arranged to pass condensed vapor and prevent the passage of vapor under pressure, and a second valve in the drain connection from the annulus arranged to pass condensed vapor and prevent the passage of vapor under pressure.

6. The structure of claim 4, wherein, the framework and track are inclined at substantially 2-½°.

* * * * *